US012234639B2

(12) United States Patent
Hebert et al.

(10) Patent No.: US 12,234,639 B2
(45) Date of Patent: Feb. 25, 2025

(54) COMPOSITE CEILING AND METHOD OF CONSTRUCTION

(71) Applicant: 9443-3638 Québec inc., Victoriaville (CA)

(72) Inventors: Dave Hebert, Saint-Christophe-d'Arthabaska (CA); Robert Cusson, Montcalm (CA)

(73) Assignee: 9443-3638 QUÉBEC INC., Victoriaville (CA)

( * ) Notice: Subject to any disclaimer, the term of this patent is extended or adjusted under 35 U.S.C. 154(b) by 21 days.

(21) Appl. No.: 17/841,842

(22) Filed: Jun. 16, 2022

(65) Prior Publication Data

US 2022/0412082 A1 Dec. 29, 2022

Related U.S. Application Data

(60) Provisional application No. 63/213,819, filed on Jun. 23, 2021.

(51) Int. Cl.
*E04B 5/36* (2006.01)
*E04B 5/38* (2006.01)

(52) U.S. Cl.
CPC ..... *E04B 5/36* (2013.01)

(58) Field of Classification Search
CPC ..... E04B 5/36
USPC ..... 52/309.9
See application file for complete search history.

(56) References Cited

U.S. PATENT DOCUMENTS 1,347,146 A * 7/1920 Davis ..... E04B 5/19 52/324
2,156,588 A * 5/1939 Hopewell ..... E04B 5/36 52/378
3,173,226 A * 3/1965 Solnick ..... E04B 5/14 52/607
3,662,506 A * 5/1972 Dillon ..... E04B 5/38 52/262
3,818,660 A * 6/1974 Dillon ..... E04B 1/161 52/79.14
3,990,193 A * 11/1976 Ray ..... E04B 1/34823 52/79.14

(Continued)

FOREIGN PATENT DOCUMENTS

CN 109356326 A * 2/2019
GB 2478739 A * 9/2011 ..... B28B 23/026

OTHER PUBLICATIONS

Conform. The Pre-Finished, Stay-in-Place Concrete Wall Framework. Version 2.0. 2012 Nuform Building Technologies Inc.

*Primary Examiner* — Jessica L Laux
*Assistant Examiner* — Joseph J. Sadlon
(74) *Attorney, Agent, or Firm* — Alexandre Daoust; Norton Rose Fulbright Canada LLP

(57) ABSTRACT

The composite ceiling can have a shell made of a polymer-based material and defining a plurality of internal compartments, having a flat and smooth under surface spaced apart from a flooring and facing the flooring, and an upper surface opposite the under surface, a first layer of rebars having a first plurality of rebars spaced apart from one another along the depth of the shell, the first layer of rebars being separated from upper surface by spacers, a second layer of rebars having a second plurality of rebars spaced apart from one another along the width of the shell, the second layer of rebars being above the first layer of rebars, and a horizontally extending concrete slab extending over the shell and surrounding the rebars.

12 Claims, 3 Drawing Sheets

(56) References Cited

U.S. PATENT DOCUMENTS 4,142,705 A * 3/1979 Miller ..... E04G 21/12 249/188
4,372,906 A * 2/1983 del Valle ..... B28B 15/00 264/279.1
4,409,764 A * 10/1983 Wilnau ..... E04B 1/165 52/204.2
4,495,131 A * 1/1985 Del Valle ..... B28B 15/00 425/88
4,574,550 A * 3/1986 Maschhoff ..... E04B 2/40 52/309.12
4,602,467 A * 7/1986 Schilger ..... E04C 2/284 52/319
4,616,459 A * 10/1986 Shubow ..... E04B 1/20 52/741.15
4,634,359 A * 1/1987 Sartorio ..... E04B 2/8617 249/161
4,693,046 A * 9/1987 Murayama ..... E04B 5/265 52/444
4,885,884 A * 12/1989 Schilger ..... E04B 5/29 52/354
4,930,278 A * 6/1990 Staresina ..... E04F 13/0862 52/600
5,177,924 A * 1/1993 Kakuk ..... E04C 2/16 52/DIG. 9
5,373,675 A * 12/1994 Ellison, Jr. ..... E04C 3/08 52/742.16
5,403,063 A * 4/1995 Sjostedt ..... B62D 33/046 52/630
5,509,243 A * 4/1996 Bettigole ..... E04C 2/423 52/414
5,553,430 A * 9/1996 Majnaric ..... E01D 11/00 52/428
5,590,499 A * 1/1997 Pischel ..... B29C 44/58 249/115
5,927,037 A * 7/1999 Kinsella ..... E04B 9/006 52/712
5,987,680 A * 11/1999 Sakaya ..... E01D 19/125 404/70
6,041,561 A * 3/2000 LeBlang ..... E04B 7/20 52/234
6,101,779 A * 8/2000 Davenport ..... E04B 1/04 52/223.6
6,241,422 B1 * 6/2001 Makowski ..... E04H 4/0006 4/491
6,293,063 B2 * 9/2001 Van Doren ..... E04B 5/14 52/250
6,625,943 B1 * 9/2003 Renner ..... E04B 5/12 52/319
6,625,948 B2 * 9/2003 Valente ..... E04B 5/36 52/745.1
6,692,186 B1 * 2/2004 Suazo ..... E02B 13/00 405/39
6,698,150 B1 * 3/2004 DiLorenzo ..... E04B 5/04 52/412
6,729,094 B1 * 5/2004 Spencer ..... E04B 5/10 52/354
7,231,746 B2 * 6/2007 Bodnar ..... E04C 2/384 52/649.3
7,353,642 B1 * 4/2008 Henriquez ..... E04B 7/02 52/404.1
7,926,241 B2 * 4/2011 Schiffmann ..... B29C 70/865 52/270
8,424,263 B2 * 4/2013 Hsieh ..... E04B 5/40 52/783.17
8,439,602 B1 * 5/2013 Suazo ..... E02B 5/02 405/118
8,495,846 B2 * 7/2013 Bravinski ..... E04B 5/48 52/340
8,943,774 B2 * 2/2015 Richardson ..... E04G 23/0203 52/514.5
8,943,776 B2 * 2/2015 Strickland ..... E04B 5/40 52/250
9,683,361 B2 * 6/2017 Timberlake ..... E04B 1/167
9,771,714 B2 * 9/2017 Castelle ..... E04B 1/7612
10,260,224 B1 * 4/2019 Jazzar ..... E04B 5/04
10,323,368 B2 * 6/2019 Mullaney ..... E01D 19/125
10,479,419 B2 * 11/2019 Storz ..... B62D 29/043
10,577,794 B2 * 3/2020 Burke ..... E04B 2/64
10,837,187 B2 * 11/2020 Wong ..... E04B 1/34807
2004/0093817 A1 * 5/2004 Pujol Barcons ..... E04G 11/087 52/294
2009/0064617 A1 * 3/2009 Montoya ..... E04B 5/043 52/425
2009/0145074 A1 * 6/2009 Tsukamoto ..... E04C 5/166 52/686
2023/0040469 A1 * 2/2023 Mathe ..... E04B 1/48

* cited by examiner

COMPOSITE CEILING AND METHOD OF CONSTRUCTION

BACKGROUND

The field of construction has been continuously evolving over the last centuries, as many new construction techniques and materials have been developed which can allow various advantages over earlier available techniques and materials. Such advantages can be various and fluctuate depending on the constantly evolving economic and social environment. They can include lowering overall material costs, lowering overall manpower requirements, improving structural resistance or durability, achieving lower overall carbon emissions, opening new possibilities, etc. Even though known construction techniques have been increasingly satisfactory over time, there always remains room for improvement.

SUMMARY

In accordance with one aspect, there is provided a composite ceiling comprising: a shell made of a polymer-based material, the shell generally having a planar, horizontally oriented, rectangular prism shape, having a width, a depth and a vertically oriented thickness, the shell defining a plurality of internal compartments, having a flat and smooth under surface spaced apart from a flooring and facing the flooring, and an upper surface opposite the under surface; a first layer of rebars having a first plurality of rebars spaced apart from one another along the depth of the shell, the first layer of rebars being separated from upper surface by spacers; a second layer of rebars having a second plurality of rebars spaced apart from one another along the width of the shell, the second layer of rebars being above the first layer of rebars; a horizontally extending concrete slab extending over the shell and surrounding the rebars.

In accordance with another aspect, there is provided a method of installing a ceiling structure comprising: mounting a temporary structure in a flooring area; laying a shell made of a polymer-based material onto the temporary structure; laying a first plurality of rebars onto the shell, with the rebars spaced apart from one another along a first horizontal orientation, with the first plurality of rebars being spaced apart from an upper surface of the shell by a plurality of spacers; laying a second plurality of rebars onto the first plurality of rebars, the second plurality of rebars being spaced apart from one another along a second orientation transversal to the first orientation; pouring fresh concrete on top of the shell and around the rebars, and allowing the concrete to set into a concrete slab; removing the temporary structure from under the shell.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
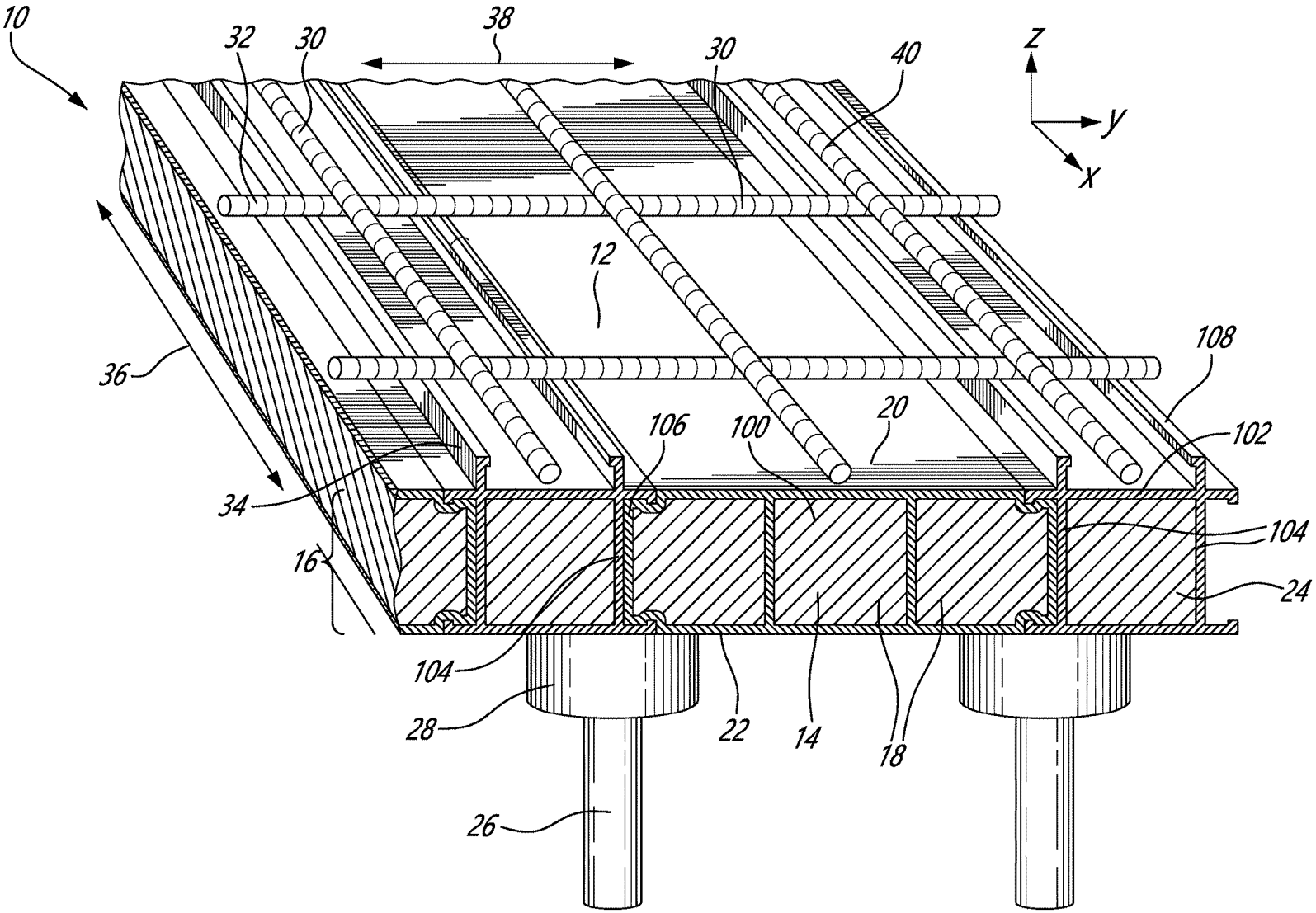
FIG. 1 is an oblique view of an example of a composite ceiling immediately prior to the step of pouring the concrete.

FIG. 1 shows an example of an unfinalized composite ceiling 10, i.e. during an intermediary construction step. More specifically, the composite ceiling 10 includes a shell 12 which is made of a polymer-based material (e.g. a plastic extrusion). The shell 12 generally has a rectangular prism shape 14, is flat and planar (i.e. significantly wider and deeper than thick), and horizontally oriented. Its thickness 16 can be said to extend vertically (generally along the z axis). The shell 12 has a plurality of internal compartments 18. More specifically, the shell 12 can be said to define an upper surface 20 opposite an lower surface 22, the upper surface 20 being connected to the lower surface 22 by a plurality of vertically-oriented internal webs 24, with the internal compartments 18 defined vertically between the upper and lower surfaces 20, 22, and horizontally between the webs 24. The lower surface 22 is flat and smooth, and can be specifically be designed in a manner to form an industrial-grade, finished surface. For instance, the polymer-based material can be selected to be easy to clean and very resistant, and of a suitable color such as white to form an aesthetically pleasing ceiling. Such a configuration can be particularly suitable for industrial buildings such as a hog barn, where frequent cleaning may be required.

In an example construction method, the shell 12 can be laid on a temporary structure 26 such as scaffolding or the like, which has been previously mounted on a flooring. The lower surface 22 faces the flooring in such a case and is placed into abutment with receiving areas 28 of the temporary structure 26.

The shell 12 can serve the dual function of serving as formwork for the casting of a concrete slab, and, by being left integrated to the concrete slab following removal of the temporary structure, can further serve as pre-finished aesthetically pleasing and/or practical ceiling material. Casting a concrete slab can involve using reinforcing steel as a tension device, incorporated within the concrete, to form reinforced concrete. Reinforced concrete can be significantly stronger in tension than non-reinforced concrete. In practice, reinforcing of concrete can be performed by suitably positioning a plurality of reinforcing bars of steel 30, commonly referred to as rebar in the art, prior to the pouring of fresh concrete, for the concrete slab to solidify around (over, below, on both sides, etc.) the rebars 30. In the context of a ceiling structure, it can be desired to position the rebar 30 in two or more orientations, and one approach can be to position the rebars 30 in two orthogonal orientations, such as in the x and y orientation respectively as shown in FIG. 1 and discussed below.

In the example presented in FIG. 1, two layers of rebars 30 are superposed onto the shell 12. More specifically, a first layer 32 of rebars 30 is laid above the shell 12 via a plurality of spacers 34, which can space the rebars 30 from the otherwise relatively flat upper surface 20 and allow the fresh concrete to penetrate between the rebars 30 and the upper surface 20. Depending on the jurisdiction where the construction is made, regulations may specify a minimum thickness for the spacing 34 between the rebars 30 and the upper surface 20, and such minimum thickness may be above 0.5 inches, above 2 inches, or even above 2.5 inches for instance, and the thickness of the spacers 34 can be selected accordingly. In the first layer 32 of rebars 30, the individual rebars 30 are spaced apart from one another in a first orientation, which we will define herein arbitrarily as the depth of the shell 36, along the x-axis, for the sake of simplicity. The individual rebars 30 are oriented in a second orientation which is orthogonal to the first orientation, and which we will, again, define herein arbitrarily as the width of the shell 38, along the y-axis.

A second layer of rebars 40 can then be superposed directly or indirectly (e.g. via other spacers, not shown) onto the first layer of rebars 32. Typically, it can be preferred for the second layer of rebars 40 to be orthogonal to the first layer of rebars 32, and therefore the rebars 30 of the second layers 40 can be spaced from one another along the width of the shell 38. In an alternate embodiment, for instance, it may be preferred to use three layers of rebars, with individual layers being rotated by 120 degrees relative to each other, in which case the second or third layer can still be said to be spaced apart from one another along the width of the shell (being in fact spaced apart both along the width and along the depth of the shell given the 120 degree angle).

Once the rebars 30 are in position such as illustrated in FIG. 1, the fresh concrete can be poured into place, onto the upper surface 20 and around the rebars 30, in a manner to form, once hardened, a reinforced concrete slab. Once the reinforced concrete slab has hardened, the temporary support structure can be removed.

Figure 2:
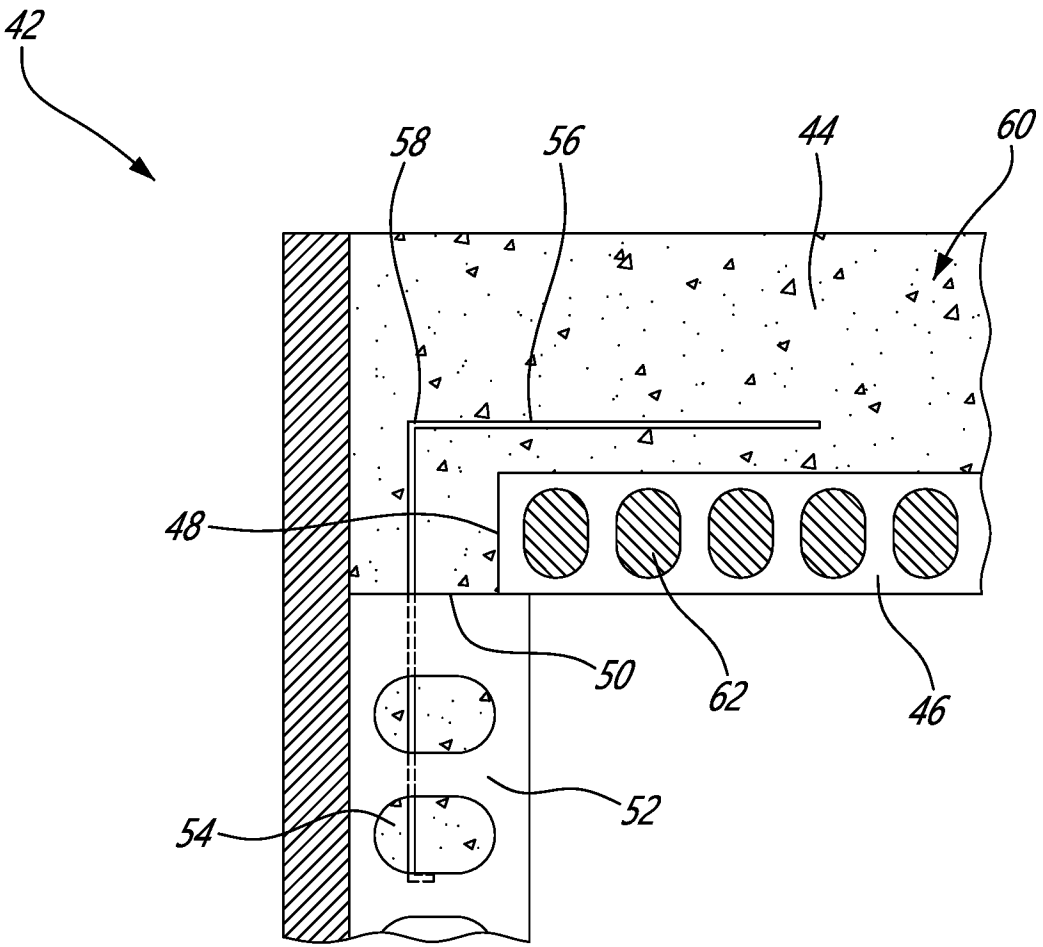
FIG. 2 is a cross-sectional view of the composite ceiling following the hardening of the concrete into a concrete slab, further showing an edge thereof.

FIG. 2 shows an embodiment of a composite ceiling after the concrete has hardened 42. In the embodiment shown in FIG. 2, the concrete slab 44 is thicker than thickness of the shell 46. In this particular embodiment, more than 1.5 times the thickness of the shell 46. The concrete slab 44 also protrudes downwardly alongside the lateral end 48 of the shell 46. Indeed, in the embodiment of FIG. 2, the lateral ends 48 of the shell 46 can abut against an upper end 50 of corresponding walls 52 which can serve as permanent support structure at those areas.

Referring specifically to the embodiment presented in FIG. 2, the walls 52 also include reinforced concrete 54. The reinforced concrete 54 can extend continuously from the walls 52 to the ceiling concrete slab 44, around the edges of the shell 48. At the edge region, the rebars 56 can be bent 58 so as to continuously extend from the wall 52 to the ceiling 60, as illustrated, if desired.

In some embodiments, it can be desired for the composite ceiling 60 to perform yet a third function in addition to or instead of the second function of providing an aesthetically pleasing finish. Such a third function can be to provide thermal insulation. To this end, it can be preferred to fill the compartments 62 of the shell 46 with an insulating foam material. The insulating foam material can be polyurethane, for instance, such as a spray foam of isocyanate and polyol resin for instance, which can be sprayed into the compartments 62 of the shell 46 in a manner to expand therein and substantially fill the compartments 62. Such an insulating foam material can be factory-applied in a manner to save time at the construction site.

Returning to FIG. 1, it was found that one practical way to form the shell 12 is to use CONFORM® pre-finished, stay-in-place concrete wall formwork made of extruded polymer-based material manufactured by Nuform Building Technologies Inc. Indeed, such concrete wall formwork is provided in the form of discrete elongated elements, which can be referred to herein as modules, which are designed to be assembled to one another at the construction site. The elements include male modules, referred to as panels, and female modules, referred to as box connectors. The elements can be formed in variable lengths and different thicknesses. In the example embodiment presented in FIG. 1, the four inch thick components (CF4) were found suitable for incorporating into the example composite ceiling structure 10. The shell 12 is assembled from male modules 100 in the form of "panel 232" elements and female modules 102 in the form of 3-way box connector elements. Two opposite ones of the female connector 104 elements of the female modules 102 serve to receive corresponding male connectors 106 of the male modules 100, whereas the third female connector element 108, provided in the form of elongated protrusions extending upwardly from the upper surface 20, can be used as spacers 34 between the upper surface 20 of the shell 12 and the first layer 32 of rebar 30. The modules 100, 102 are elongated and can be assembled at the construction site by sliding male components 106 along the length of female components 104, 108 or vice-versa. When assembled, the modules 100, 102 can extend horizontally in a side-by-side configuration. When embodied in this manner, the spacers 34 are elongated along the length of the female modules 102, and the first layer 32 of rebars 30 can be received transversally to the length of the modules 102. The modules 100, 102 have individual upper surfaces 20, lower surfaces 22 and webs 24 delimiting one or more elongated compartment 18 between longitudinal ends, the elongated compartment 18 being open at both ends. The elongated compartment 18 can be filled with insulating foam at a factory, before transport to the construction site.

Figure 3:
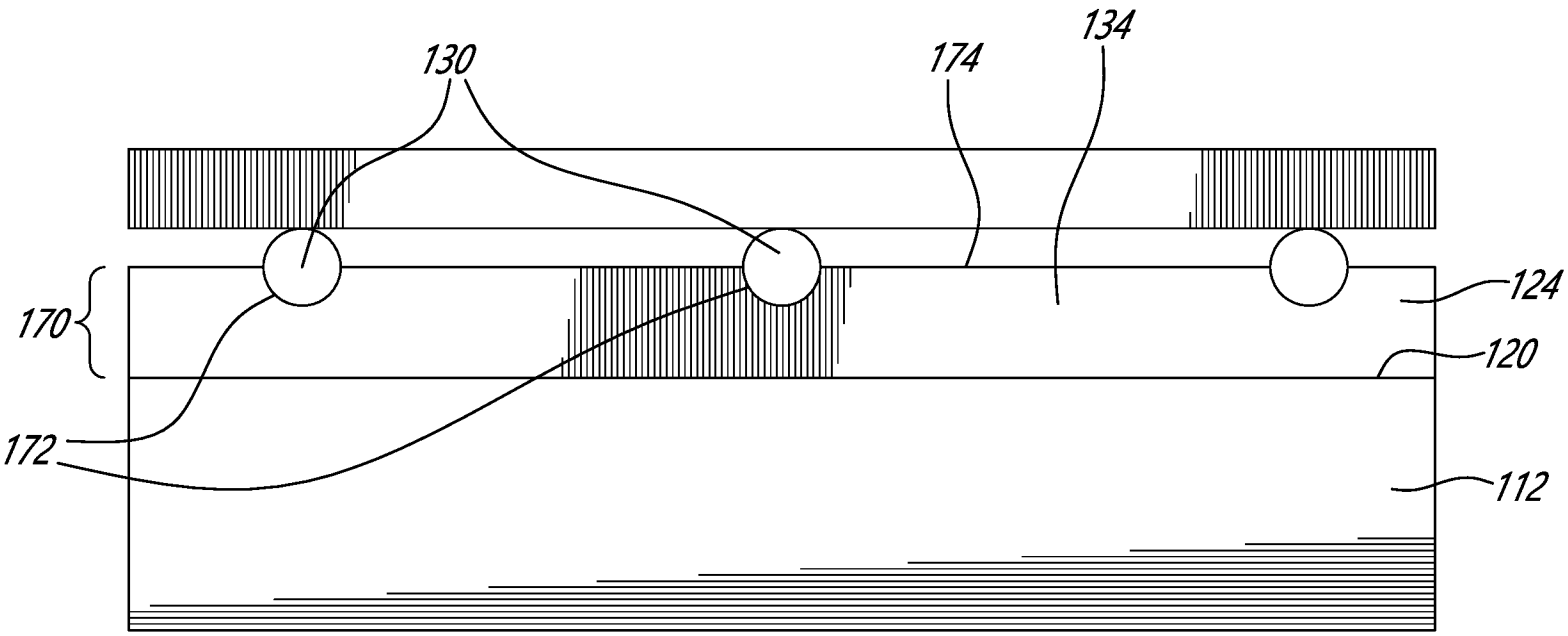
FIG. 3 is a side elevation view of another example of a composite ceiling immediately prior to the step of pouring the concrete.

It will be understood that the use of CONFORM® pre-finished formwork modules is but one of many possible implementations of a shell, and while it may be suitable for some embodiments, it may be considered less suitable for others. In some embodiments, it can be preferred to design a shell of polymer-based material having the desired characteristics and perhaps be even better adapted to use in a composite ceiling. In particular, it can be preferred to design a shell which has integrated spacers which are better adapted for the role of supporting rebars. An example of such a shell is presented in FIG. 3. In the embodiment presented in FIG. 3, a plurality of elongated webs 124 which are spaced apart from one another protrude upwardly from an upper face 120 of the shell 112 forming spacers 134, generally such as presented in FIG. 1, but the spacers 134 can be equally interspaced from one another instead of being grouped in pairs. Moreover, the spacers 134 can be thicker than the spacers 34 of FIG. 1, such as to create a spacing 170 of 2 or 2.5 inches between the rebar 130 and the upper surface 120 of the shell 112 for instance. Also, the spacers 134 can be provided with integrated rebar seats 172. In the embodiment presented in FIG. 3, the rebar seats 172 are provided in the form of semi-circular recesses from an upper edge of the webs 174, and the semi-circular recesses are dimensioned as a function of a diameter of the rebars 130, in a manner for the rebar 130 to sit stably into the rebar seats 172 when positioned therein and avoid moving/rolling due to external forces such as light bumping or the wind.

As can be understood, the examples described above and illustrated are intended to be exemplary only. The scope is indicated by the appended claims.

What is claimed is:

1. A composite ceiling comprising:

a shell made of a polymer-based material, the shell generally having a planar, horizontally oriented, rectangular prism shape, having a width, a depth and a vertically oriented thickness, the shell having a flat and smooth under surface spaced apart from a flooring and facing the flooring, the shell having an upper surface opposite the under surface; the shell having a plurality of internal compartments disposed between the under surface and the upper surface; the shell having a plurality of spacers provided in the form of corresponding protrusions of the shell extending upwardly from the upper surface, the protrusions being elongated along the depth of the shell, the protrusions being narrow in the orientation of the width of the shell, the protrusions being interspaced from one another along the width of the shell;

a first layer of rebars having a first plurality of rebars spaced apart from one another along the depth of the shell, the in contact with disposed on top of the spacers and separated from the upper surface by the spacers;

a second layer of rebars having a second plurality of rebars spaced apart from one another along the width of the shell, the in contact with disposed on top of the first layer of rebars;

a horizontally extending concrete slab extending over the first and second plurality of rebars.

2. The ceiling structure of claim 1 wherein the internal compartments are filled with an insulating foam material.

3. The ceiling structure of claim 2 wherein the insulating foam material is polyurethane.

4. The ceiling structure of claim 1 wherein the spacers are at least 2 inches in thickness.

5. The ceiling structure of claim 1 wherein the protrusions have a plurality of rebar seats interspaced from one another along the depth of the shell.

6. The ceiling structure of claim 5 wherein the rebar seats and provided in the form of corresponding semi-circular recesses from an upper edge of the protrusions.

7. The ceiling structure of claim 1 wherein the shell includes a plurality of individual modules, each module defining at least one of the elongated internal compartments, the modules being assembled to one another in a horizontal side-by-side configuration.

8. The ceiling structure of claim 7 wherein the individual modules includes male modules assembled horizontally between female modules.

9. The ceiling structure of claim 1 wherein the shell has horizontal ends, the horizontal ends each being supported by a corresponding wall.

10. The ceiling structure of claim 9 wherein the walls include a wall shell made of a polymer-based material, the wall shell generally having a planar, vertically oriented, rectangular prism shape, having a width, a depth and a vertically oriented height, the wall shell including a plurality of elongated internal compartments disposed parallel to each other, each wall shell having a flat and smooth inner surface spaced apart from and facing the other wall, the elongated internal compartments being filled with concrete.

11. The ceiling structure of claim 10 wherein the first plurality of rebars are bent at the horizontal ends and penetrate vertically into the concrete filling the elongated internal compartments of the wall shells.

12. The ceiling structure of claim 1 wherein the protrusions have an inversed-L-shaped cross-sectional shape.

* * * * *